United States Patent [19]

Hartman et al.

[11] Patent Number: 5,070,786

[45] Date of Patent: Dec. 10, 1991

[54] STANDOFF SENSOR ANTENNAE FOR MUNITIONS HAVING EXPLOSIVELY FORMED PENETRATORS

[75] Inventors: David S. Hartman, Eden Prairie; Daniel F. Cheeseman, Maple Grove, both of Minn.

[73] Assignee: Honeywell, Inc., Minneapolis, Minn.

[21] Appl. No.: 588,274

[22] Filed: Sep. 26, 1990

[51] Int. Cl.[5] ..... F42C 13/04; F42B 12/10

[52] U.S. Cl. ..... 102/214; 102/476

[58] Field of Search ..... 102/214, 384, 476

[56] References Cited

U.S. PATENT DOCUMENTS

| | | | |
|---|---|---|---|
| 3,152,547 | 10/1964 | Kyle | 102/214 |
| 3,838,645 | 10/1974 | Finger et al. | 102/211 |
| 3,903,523 | 9/1975 | Hartley, Jr. | 102/214 |
| 3,922,968 | 12/1975 | Conger et al. | 102/214 |
| 4,160,415 | 7/1979 | Cole | 102/214 |
| 4,554,871 | 11/1985 | Nixon | 102/214 |
| 4,584,943 | 4/1986 | Vavra et al. | 102/214 |
| 4,622,901 | 11/1986 | Witt et al. | 102/214 |
| 4,691,636 | 9/1987 | Witt et al. | 102/214 |
| 4,756,254 | 7/1988 | Bai et al. | 102/214 |

*Primary Examiner*—Charles T. Jordan

*Attorney, Agent, or Firm*—Haugen and Nikolai

[57] ABSTRACT

A munitions employing explosively formed penetrator warhead includes a microstrip antennae pattern on its concave face and is configured such that its presence does not impede or deleteriously affect the ability of the EFP to form into a molten armor-piercing projectile following detonation. The concave surface of the warhead serves as the conductive ground plane for the microstrip antennae and a dielectric layer having the microstrip antennae pattern formed on a first surface thereof is bonded to the warhead. A feedthrough which passes through an aperture near the edge of the warhead allows the antennae to be coupled to the transmit/-receive electronics used along with the antennae to detonate the munitions upon its reaching a predetermined standoff distance from the armor surfaces of the target to be destroyed.

1 Claim, 1 Drawing Sheet

STANDOFF SENSOR ANTENNAE FOR MUNITIONS HAVING EXPLOSIVELY FORMED PENETRATORS

BACKGROUND OF THE INVENTION

I. Field of the Invention

This invention relates generally to munitions of war, and more particularly to the configuration of a standoff sensor antenna on the face on an explosively formed penetrator (EFP) whereby the munitions can be exploded upon reaching a predetermined standoff distance from the target.

II. Discussion of the Prior Art

Those skilled in the art recognize that certain anti-armor munitions employing EFP warheads, such as a Miznay-Shardin type of warhead, generally require five to six charge diameters of standoff distance from armor surfaces at the time of detonation to properly form the penetrating, molten metal jet used to defeat the armored target. Munitions with the EFP warhead are generally comprised of a cylindrical canister containing an explosive charge and a metal warhead secured to the end of the canister and especially formed to provide a forward-facing concave surface. Groups of such munitions are commonly dropped from aircraft as a cluster and during their descent, small parachutes built into the munitions deploy to control the rate of spin and descent of the munitions toward the target or targets to be destroyed. These types of munitions can be deployed by artillery shells as well and would typically deploy a parachute or drogue chute for spin/speed stabilization.

To provide the desired standoff distance required for proper EFP formation, such munitions have been equipped with an elongated probe, typically exceeding two feet in length, and passing through the center of the warhead. When the tip of the probe touches a surface, such as armor plate or the ground, the charge is detonated and because the spacing provided by the probe configuration, the warhead can invert and liquify and form into a shape permitting penetration of armor plate. It has been found that the presence of such a probe significantly interferes with the formation of the penetrator, adversely affecting its armor piercing capabilities.

Standoff initiation of EFP warheads has also been accomplished utilizing electronic means. Specifically, radio frequency (RF) proximity sensors have been incorporated into Miznay-Shardin weaponry whereby the munitions is made to explode above the target surface or ground.

There are three known prior art standoff sensor antenna configurations which have been employed on submunitions. In a first arrangement, the concave face of the EFP is filled with a plastic foam to provide a flat, planar surface on which the antenna is disposed. This arrangement is used primarily for more expensive, target ranging and detection systems and is not particularly suitable for low-cost, short range EFP standoff. Because of the thickness of the foam layer, the conductive EFP cannot function as a ground plane for a microstrip antenna nor can the EFP be relied upon to provide radiation shaping of the antenna beam pattern.

In a second prior art arrangement, the proximity sensor and electronics associated therewith protrude through the apex of the conductive EFP and does not differ significantly from the probe arrangement previously discussed. That is to say, because the electronics and antenna protrude through the thickness dimension of the EFP, it will act to substantially degrade the performance of the EFP in that a significant portion of the whole EFP is missing.

In a third arrangement, a ring is provided around the base of the EFP allowing a ring dipole antenna and the RF sensor electronics configured in an annular shape around the circumference of the EFP base. While this configuration will not impact the EFP formation significantly, the configuration, for antenna purposes, is far from ideal. In that the dipole antenna must be bent around in a circular arch to fit the ring form, it will yield less than optimal antenna radiation patterns. Moreover, the ring approach requires more volume for packaging and would sustain the brunt of G-loading if used in a high setback (gun-fired) application, leading to questionable survivability.

OBJECTS

It is accordingly a principal object of the present invention to provide an improved transmit/receive antenna for a munitions having an EFP warhead.

Another object of the invention is to provide an ammunition employing EFP warheads having an improved standoff sensor antennae mounted thereon and which does not interfere with proper formation of the molten metal projectile.

SUMMARY OF THE INVENTION

The above objects and advantages of the invention are achieved by providing directly on the exposed concave face of the metal EFP warhead a thin dielectric substrate on which is etched or otherwise formed a metal antenna pattern. The warhead itself comprises a ground plane and the dielectric and the antenna pattern complete a microstrip circuit. The antenna feed points are connected by leads back to the sensor electronics housed within the munitions's explosive containing canister.

Any one of several methods may be employed in forming the antenna structure on the concave face of the EFP liner. For example, the dielectric layer may be sprayed or otherwise applied to the metal EFP liner and once cured, the antenna may be applied to that dielectric layer using appropriate screening techniques to define its pattern. Alternatively, the antenna pattern can be preprinted on a flexible dielectric sheet, the sheet being slit appropriately so that it may be bonded to the concave surface of the EFP liner without wrinkling.

Other aspects of the invention will become apparent to those skilled in the art from the following detailed description of the preferred embodiment, especially when considered in conjunction with the accompanying drawings in which like numerals in the several views refer to corresponding parts.

DESCRIPTION OF THE PREFERRED EMBODIMENT

Figure 1:
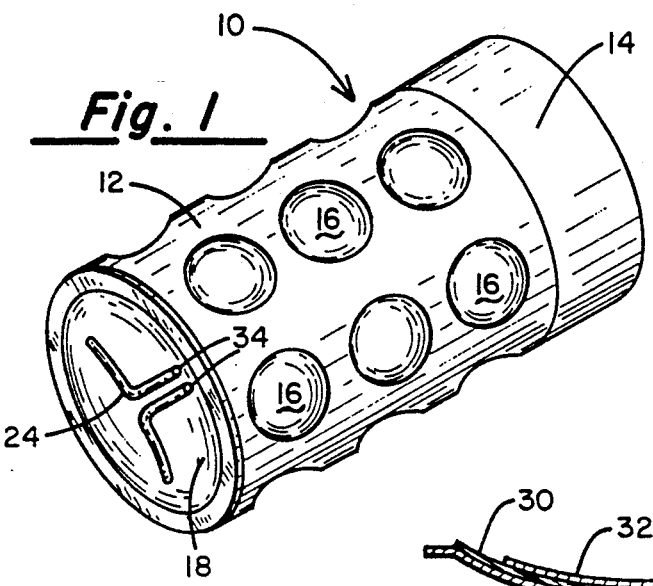
FIG. 1 is a perspective view of a munition employing a EFP warhead and an antenna system in accordance with the present invention.

Referring to the perspective view of FIG. 1 indicated generally by numeral 10 is an anti-armor munition which, upon detonation, dispatches an EFP warhead which becomes shaped during flight to form a molten slug of an appropriate shape to facilitate its penetrating through armor plate of predetermined thickness. Before its explosion, the munition comprises a generally cylindrical housing 12 generally formed from a ductile metal, such as steel, and may typically be two to eight inches in diameter. Affixed to the upper surface of the cylindrical housing 12 is a further cylindrical housing 14 containing a parachute stabilizer which becomes deployed after such munitions are dispensed from a carrier into an airstream.

The wall of the cylindrical housing 12 is covered by a series of concave dimples, as at 16, which, upon detonation of the munition are formed into separate spherical-shaped projectiles.

Attached to the bottom edge of the cylinder 12 is the EFP warhead and it comprises a concave metal liner 18, the liner being approximately 100–400 mils thick and formed from a ductile metal, such as copper or tantalum.

Figure 6:
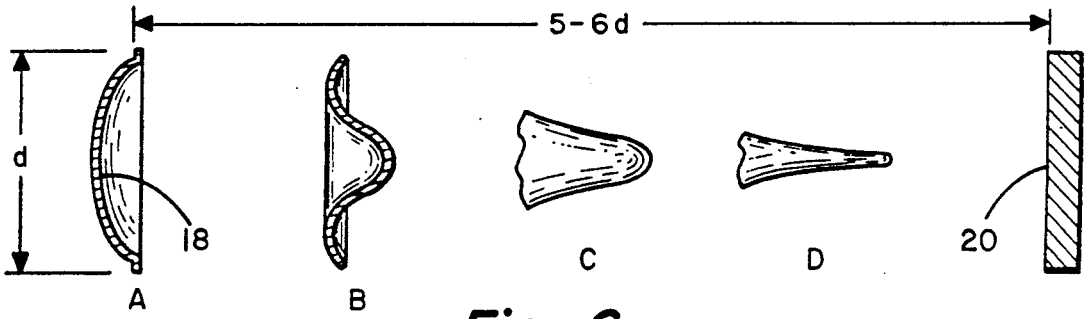
FIG. 6 is a drawing illustrating the manner in which the warhead inverts to become an EFP.

Referring momentarily to FIG. 6, there is shown by a series of drawings A, B, C and D, the way in which the EFP liner 18 forms into a molten projectile directed at an armor target 20 under the force of the exploding charge contained within the canister 12. As indicated by B, the concave metal warhead inverts and, as shown in C and D, becomes an aero-dynamically-shaped molten projectile during flight. It has been determined that a minimum standoff distance between the target 20 and the warhead 18 at the time of detonation is required so that the projectile can properly form prior to impact with the target. It has been found that if the diameter of the warhead 18 is d, then the standoff distance should be in the range of 5 to 6 d as shown in FIG. 6.

In accordance with the present invention, detonation at the proper standoff distance is achieved by providing RF sensor electronics 22 within the munition 12 and a microstrip antenna 24 on the concave face of the warhead 18. The transmitter/receiver 22 may then be connected by a transmission line 26 to the microstrip pattern 24. When appropriately energized, the antenna 24 will radiate electromagnetic energy toward the target and sense the return from that target. When the transit time of the signal to the target and back indicates to the receiver electronics a separation in the range of from 5 to 6 d, the explosive charge 28 contained within the munition 10 is detonated.

Figure 5:
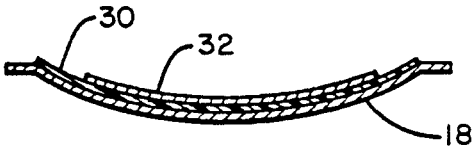
FIG. 5 is a cross-section along the lines 5—5 in FIG. 3.
Figure 2:
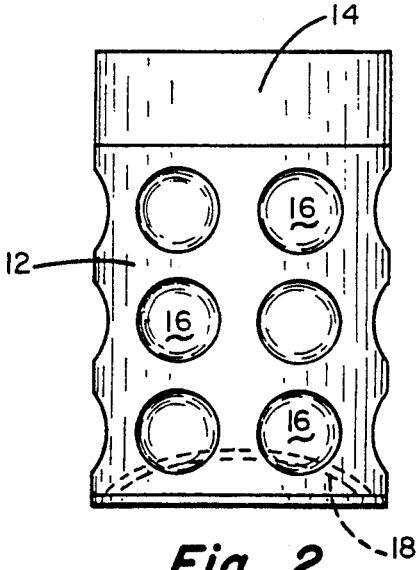
FIG. 2 is a side elevation of the munition of FIG. 1.
Figure 4:
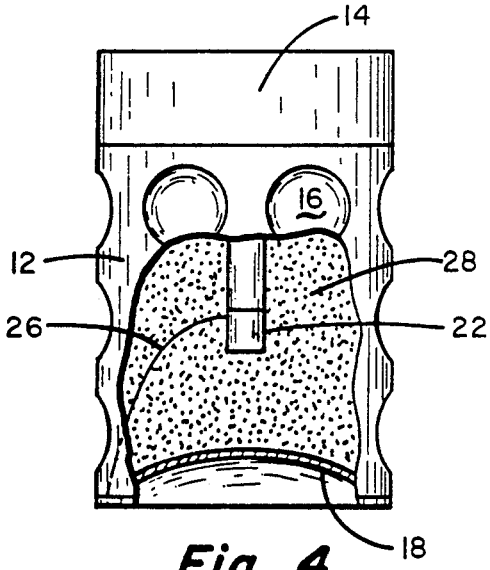
FIG. 4 is a broken-away view showing interior structure in the munition of FIG. 1.

Referring to the drawings, and especially to FIG. 5, the warhead 18 comprises a ground plane for a microstrip antenna. A suitable dielectric layer 30 is adhered to the concave face of the warhead 18 and that dielectric substrate carries the antenna pattern 32 thereon. In the drawings, a common dipole antenna configuration is shown for simplicity, but it is to be understood that the principles of this invention allow other antenna shapes for the sensor and can be tailored using known design techniques to yield a desired radiation pattern. Hence, the invention is not to be limited to the use of only a dipole antenna. The transmission line 26 extends through apertures (not shown) formed at the edge of the metal warhead 18 and connect to the feed points 34 of the antenna.

In the cross-sectional view of FIG. 5, the metallic strip line antenna 32, the dielectric layer 30 and the warhead 18 which comprises the ground plane of the microstrip circuit are not necessarily shown in proportion, those skilled in the art recognizing that the dielectric layer 30 and the etched pattern of the antenna 32 may be quite thin in comparison to the ground plane 18.

The EFP liner itself thus functions not only as the structural support for the antenna, but also as its electrical ground plane. Because of its concave shape, it also functions to forward-shape the antenna radiation pattern to increase the effective gain of the antenna, thereby increasing its target surface detection capability and decreasing its susceptibility to enemy electronic countermeasures.

Various production processes may be used to form the microstrip antenna pattern onto the face of the warhead 18. For example, a layer of dielectric-type material in liquid form may be sprayed or otherwise coated to a desired thickness to the concave or forward face of the warhead 18. After the dielectric material has been cured, the metallic stripline antenna may be affixed to the dielectric in a desired pattern. A protective, RF transparent sealing layer may also be added over the entire surface to prevent corrosion or wear.

Another production method would be to affix a flexible printed circuit to the concave face of the warhead. Here, the antenna pattern is formed onto a flexible dielectric substrate and then that substrate is appropriately slit so that it can be made to conform to the concave face of the warhead liner 18. An appropriate adhesive may be used to bond the dielectric substrate to the liner. Alternatively, the flexible substrate may have a continuous layer of metalization, e.g., copper, of a predetermined thickness and following the adhesion of the copper clad dielectric to the warhead liner, an etching process may be utilized to create the desired antenna pattern, in situ.

Figure 3:
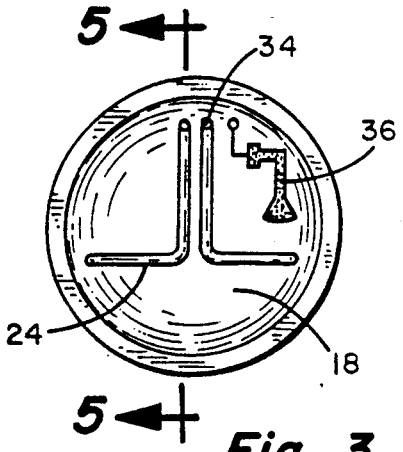
FIG. 3 is a bottom view of the device of FIG. 2.

As shown in FIG. 3, it is also contemplated that other etched conductors 36 over and above the antenna pattern may be formed on the dielectric layer. This may be desirable where the down converter or mixer electronics is mounted on the convex side of the warhead in close proximity to the antenna such that lower, intermediate frequency (IF) signals may be delivered to the transmit/receive module 22 contained within the munition canister 12, via the transmission line 26.

It can be seen, then, that the present invention affords a way of locating the standoff sensor antenna structure directly onto the forward, or concave, face of a Miznay-Shardin EFP or shaped charge warhead liner. The charge liner itself acts as a structural support for the antenna and as its electrical ground plane and, in certain cases, serves to optimally shape the resulting antenna radiation pattern. Using this approach results in an overall reduction of munition weight and volume and lends itself to high-g or gun-fired warhead applications. Because of the simplification afforded by the invention, fewer separate parts are required enhancing the munition's produceability.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. In an explosively formed penetrator warhead munition of the type including a generally cylindrical housing containing an explosive charge, a signal transmitter/receiver located within said housing and a metal warhead liner affixed to one end of said housing, said warhead liner having an outwardly facing concave surface, the improvement comprising:

(a) a strip line antenna secured to said concave surface including an insulating layer conforming and adhering to said concave surface of said metal warhead liner and a conductive antenna pattern including a tie point adhered to the exposed concave surface of said layer, said metal warhead liner serving as the ground plane for said strip line antenna, said concave surface forward-shaping an antenna radiation pattern generated by said antenna when energized;

(b) means connecting said antenna to said signal transmitter/receiver including a transmission line connected to said tie point;

(c) mixer electronics secured to said concave surface nearly proximate said antenna; and (d) means connecting said mixer electronics to said antenna.

* * * * *